US008335134B1

(12) United States Patent
Sneed

(10) Patent No.: US 8,335,134 B1
(45) Date of Patent: Dec. 18, 2012

(54) CLOCK DEVICE WITH DAYLIGHT SAVING TIME ADJUSTMENT

(76) Inventor: Rufus Sneed, Florence, SC (US)

( * ) Notice: Subject to any disclaimer, the term of this patent is extended or adjusted under 35 U.S.C. 154(b) by 253 days.

(21) Appl. No.: 12/909,496

(22) Filed: Oct. 21, 2010

(51) Int. Cl.
*G04B 25/00* (2006.01)
*G04B 37/00* (2006.01)

(52) U.S. Cl. ..... 368/71; 368/313

(58) Field of Classification Search ..... 368/69–70, 368/71–75, 313
See application file for complete search history.

(56) References Cited

U.S. PATENT DOCUMENTS

| | | | | | |
|---|---|---|---|---|---|
| 1,853,484 | A | * | 4/1932 | Wolf | 368/207 |
| 2,665,542 | A | * | 1/1954 | Sheldon | 368/204 |
| 4,236,239 | A | * | 11/1980 | Imgruth et al. | 368/72 |
| 4,763,311 | A | | 8/1988 | Marvosh | |
| 4,920,365 | A | | 4/1990 | Marx et al. | |
| 4,953,149 | A | | 8/1990 | Marvosh | |
| 5,901,115 | A | | 5/1999 | Katzmann et al. | |
| 6,595,683 | B1 | * | 7/2003 | Cetera | 368/316 |
| D561,611 | S | | 2/2008 | Chu et al. | |
| 7,394,726 | B2 | | 7/2008 | O'Neill et al. | |
| 2006/0018202 | A1 | * | 1/2006 | Girardin et al. | 368/281 |
| 2006/0133220 | A1 | * | 6/2006 | Bhavnani | 368/276 |
| 2007/0274163 | A1 | * | 11/2007 | Wild | 368/316 |
| 2009/0257323 | A1 | * | 10/2009 | Soltani | 368/281 |

* cited by examiner

*Primary Examiner* — Sean Kayes

(57) ABSTRACT

A clock device for switching between standard and daylight saving time. The device features a housing with standard alarm clock features. A recess is disposed in the front of the housing. A digital display piece having a front face with a first digital display and a back face with a second digital display snaps into the recess in the housing. The digital display piece can rotate such that either the first or the second digital display faces forwardly. The first digital display is adapted to display standard time and the second digital display is adapted to display daylight saving time. A time change button is disposed on housing, the time change button can pivot between a standard time position and a daylight saving time position. The time change button rotates the digital display piece such that either the first digital display faces forwardly or the second digital display faces forwardly.

8 Claims, 5 Drawing Sheets

100

CLOCK DEVICE WITH DAYLIGHT SAVING TIME ADJUSTMENT

FIELD OF THE INVENTION

The present invention is directed to a digital clock, more particularly to a digital clock with a feature allowing a user to adjust the time for daylight saving time purposes.

BACKGROUND OF THE INVENTION

Participating in daylight saving time requires that individuals change the times of their clocks twice a year. For those who have several clocks, this task can be particularly time consuming. The present invention features a clock device with a feature allowing for users to switch from standard time to daylight saving time and vice versa.

Any feature or combination of features described herein are included within the scope of the present invention provided that the features included in any such combination are not mutually inconsistent as will be apparent from the context, this specification, and the knowledge of one of ordinary skill in the art. Additional advantages and aspects of the present invention are apparent in the following detailed description and claims.

SUMMARY

The present invention features a clock device that can switch between standard time and daylight saving time. In some embodiments, the clock device comprises a clock housing having a speaker, a power source, and control buttons. The speaker, power source, and control buttons are each operatively connected to a microprocessor. The microprocessor is configured to digitally keep time in a standard manner. A recess is disposed in a front area of the housing. A first shaft hole is disposed in a first side wall of the clock housing and a second shaft hole is disposed in a second side wall of the clock housing.

The device further comprises a digital display piece having a front face with a first digital display and a back face with a second digital display. The first digital display is oriented in a first direction and the second digital display is oriented in a second direction, the second direction being upside down with respect to the first direction. The first digital display is adapted to display standard time and the second digital display is adapted to display daylight saving time. The digital display piece is adapted to fit into the recess in the front area of the housing.

The device further comprises a first shaft disposed on a first side of the digital display piece and a second shaft disposed on a second side of the digital display piece. The first shaft is adapted to be inserted into the first shaft hole of the housing and the second shaft is adapted to be inserted into the second shaft hole of the housing. The first shaft can rotate within the first shaft hole and the second shaft can rotate within the second shaft hole such that the first digital display is facing outwardly from the front area of the housing or the second digital display is facing outwardly from the front area of the housing.

The device further comprises a first electrical contact disposed on a top front edge of the housing near the first side wall and a second electrical contact disposed on the top front edge of the housing near the second side wall. The first electrical contact and second electrical contact are each operatively connected to the microprocessor.

The device further comprises a third electrical contact disposed on a top edge of the digital display piece near the second side and a fourth electrical contact disposed on a bottom edge of the display piece near the first side. When the display piece is engaged in the front area of the housing with the first digital display facing forwardly the second electrical contact on the housing operatively connects to the third electrical contact on the display piece and the microprocessor sends a first output signal to the first digital display to cause the first digital display to display standard time. When the display piece is engaged in the front area of the housing with the second digital display facing forwardly the first electrical contact on the housing operatively connects to the fourth electrical contact on the display piece and the microprocessor sends a second output signal to the second digital display to cause the second digital display to display daylight saving time.

The device further comprises a time change button disposed on the first side wall of the housing. The time change button is aligned with the first shaft hole in the housing. The time change button is operatively connected to the first shaft of the digital display piece. The time change button can pivot between at least a first position and a second position. When the time change button is in the first position the first digital display faces forwardly and when the time change button is in the second position the second digital display faces forwardly.

In some embodiments, the control buttons include clock setting buttons, alarm setting buttons, volume buttons, and a snooze button. In some embodiments, the clock device further comprises a footing disposed on a bottom surface of the housing for traction. In some embodiments, the first digital display and the second digital display are separate pieces that together form the digital display piece. In some embodiments, the power source is a battery. In some embodiments, the battery is a rechargeable battery. In some embodiments, a fifth electrical contact is disposed in the first shaft of the digital display piece. In some embodiments, the time change button is operatively connected to the fifth electrical contact.

DESCRIPTION OF PREFERRED EMBODIMENTS

Figure 1:
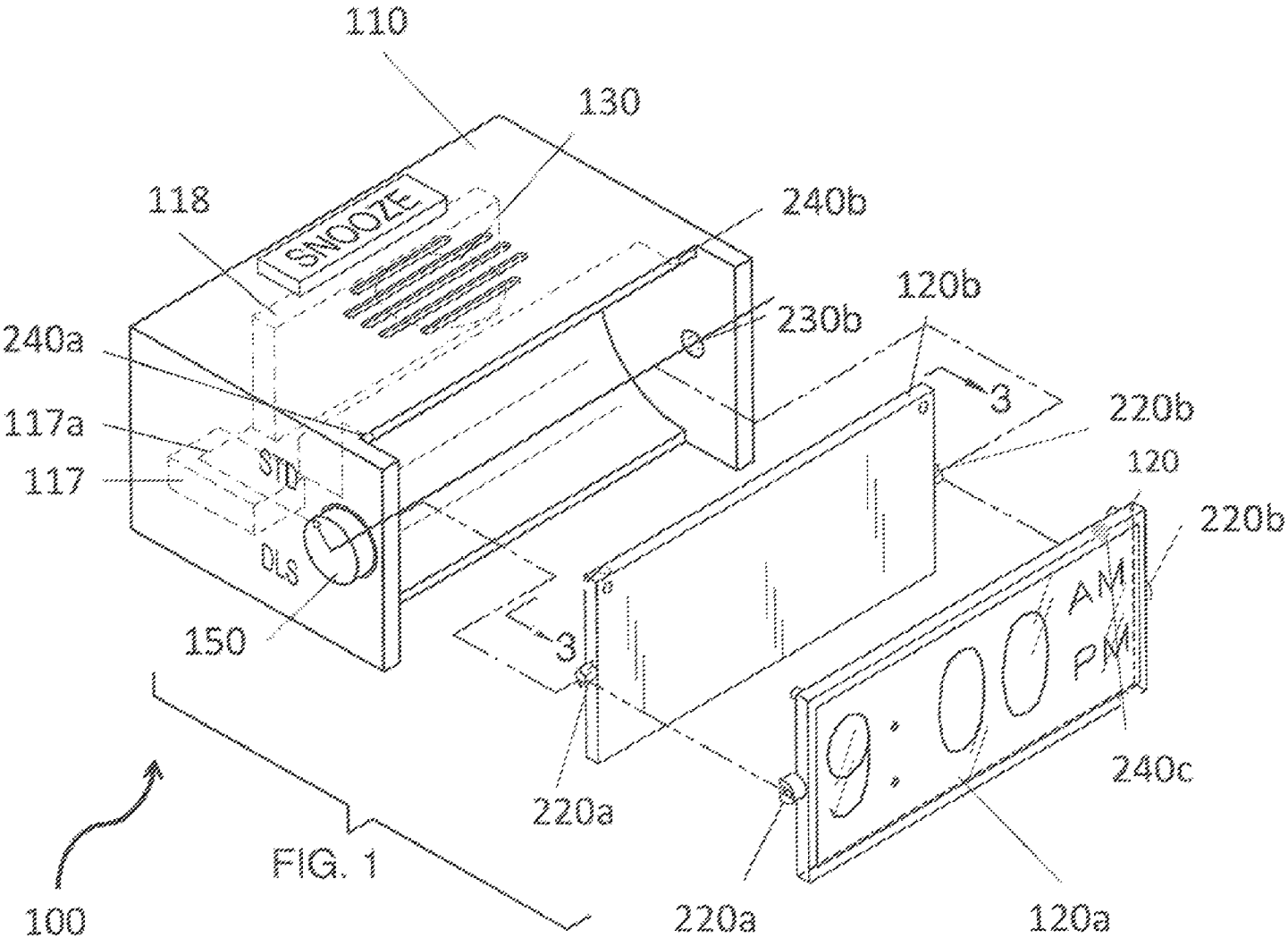
FIG. 1 is an exploded view of the clock device of the present invention.

Referring now to FIGS. 1-5, the present invention features a clock device 100 with a feature allowing for users to switch from standard time to daylight saving time and vice versa. The clock device 100 comprises a clock housing 110 resembling standard digital clocks. For example, the housing 110 comprises a speaker 130, a power source 117 (e.g., a battery, a rechargeable battery), and control buttons 140 (e.g., clock setting buttons, alarm setting buttons, volume buttons, a snooze button 145), which are operatively connected to a microprocessor 118 (e.g., via wires 117*a*). The microprocessor is configured keep time (e.g., digitally) and display the time on the display 120, like standard digital clocks. Microprocessors for digital clocks are well known to one of ordinary skill in the art. In some embodiments, footings 125 may be disposed on the bottom surface of the housing 110 for traction purposes.

Figure 1A:
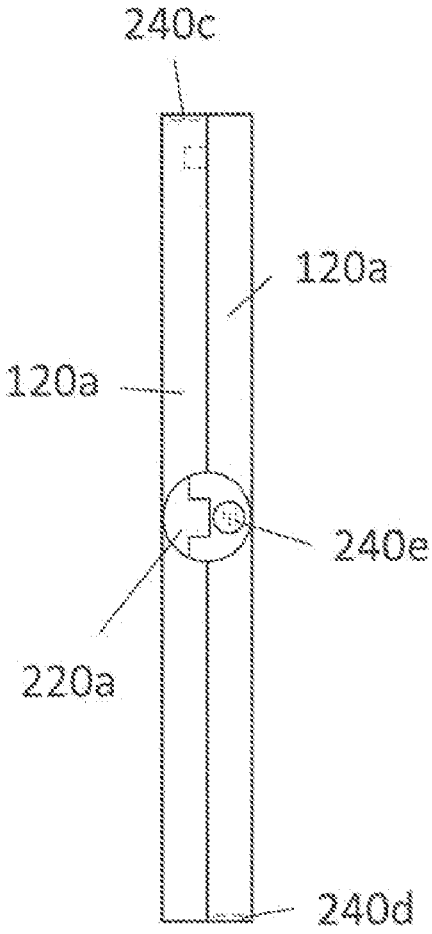
FIG. 1A is a side view of the digital display piece of the clock device of the present invention.
Figure 1B:
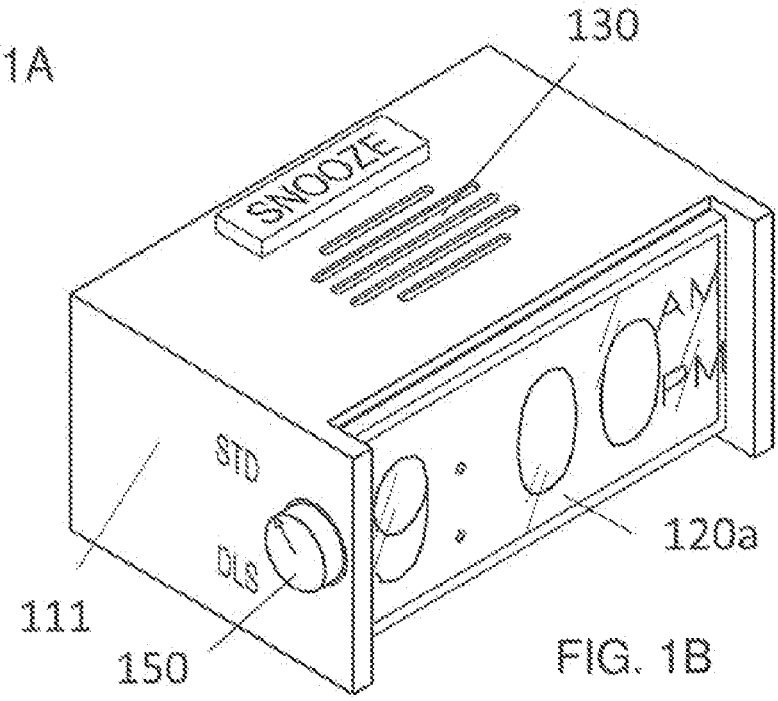
FIG. 1B is front a perspective view of the clock device of the present invention.

The clock device 100 further comprises a digital display piece 120 having a front face with a first digital display 120*a* and a back face with a second digital display 120*b*. The first digital display 120*a* is oriented in a first direction and the second digital display 120*b* is oriented in a second direction, for example the second digital display 120*b* is upside down (see FIG. 3). Thus, when a user faces the first digital display 120*a* the image is upright, and when he/she flips the digital display piece 120 over the second digital display 120*b* appears upright. In some embodiments, as shown in FIG. 1, the digital display piece 120 is two pieces, the first digital display 120*a* being on a front piece and the second digital display 120*b* being on a back piece. FIG. 1A is a side view of the digital display piece 120 showing the first digital display 120*a* and second digital display 120*b* connected together.

The first digital display 120*a* is adapted to display standard time and the second digital display 120*b* is adapted to display daylight saving time (e.g., 1 hour behind standard time).

Disposed on the first side of the first digital display 120*a* and on the first side of the second digital display 120*b* is a first shaft 220*a*. Disposed on the second side of the first digital display 120*a* and on the first side of the second digital display 120*b* is a second shaft 220*b*. The first shafts 220*a* are adapted to be inserted into (e.g., snapped into) a first shaft hole disposed in the inner surface of the first side wall of the housing 110 and the second shafts 220*b* are adapted to be inserted into (e.g., snapped into) a second shaft hole 230*b* disposed in the inner surface of the second side wall of the housing 110.

The display piece 120 (e.g., first digital display 120*a* and second digital display 120*b*) snaps into a recess disposed in the front area of the housing 110. The display piece 120 can pivot about the shaft holes disposed in the housing 110 (e.g., see FIG. 4) such that the first digital display 120*a* is facing forward or the second digital display 120*b* is facing forward.

Figure 2:
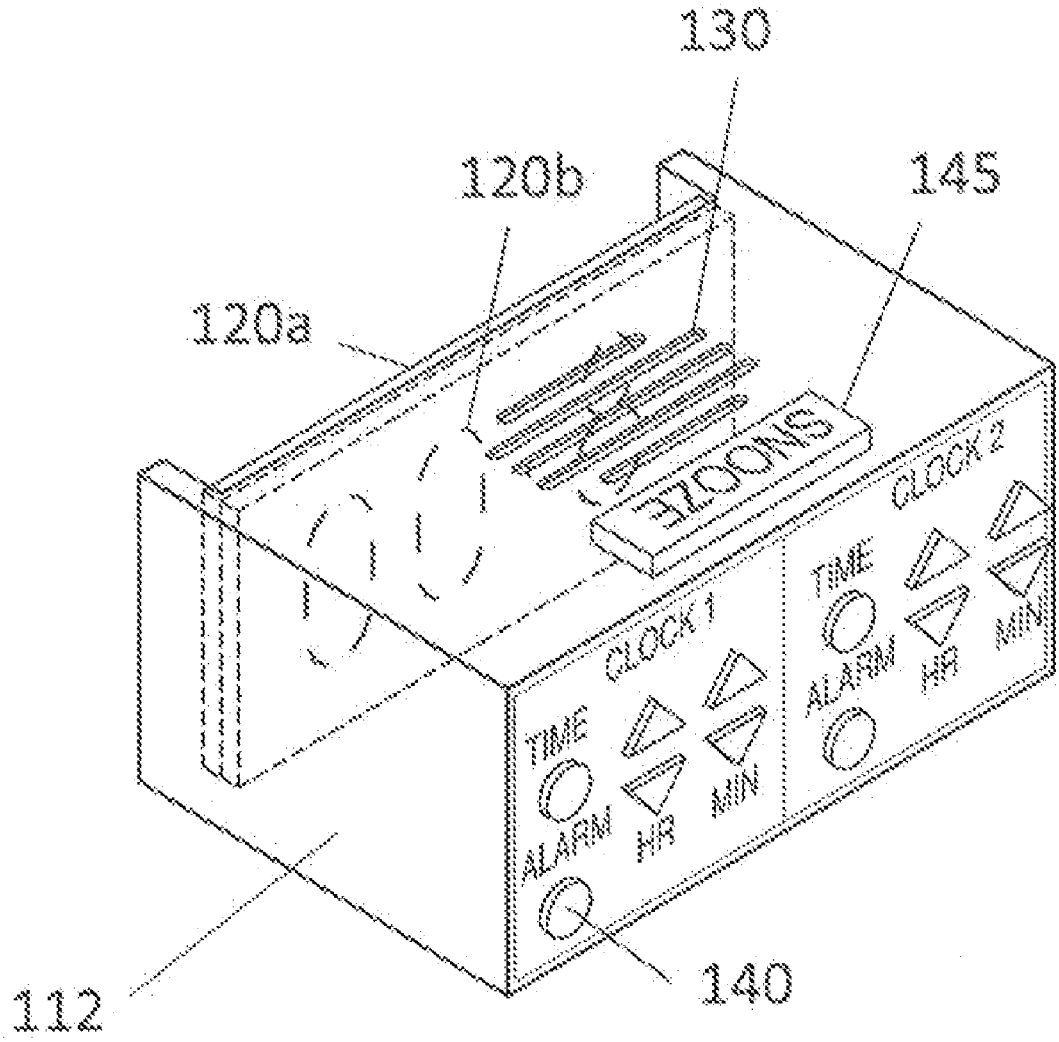
FIG. 2 is a back perspective view of the clock device of the present invention.
Figure 3:
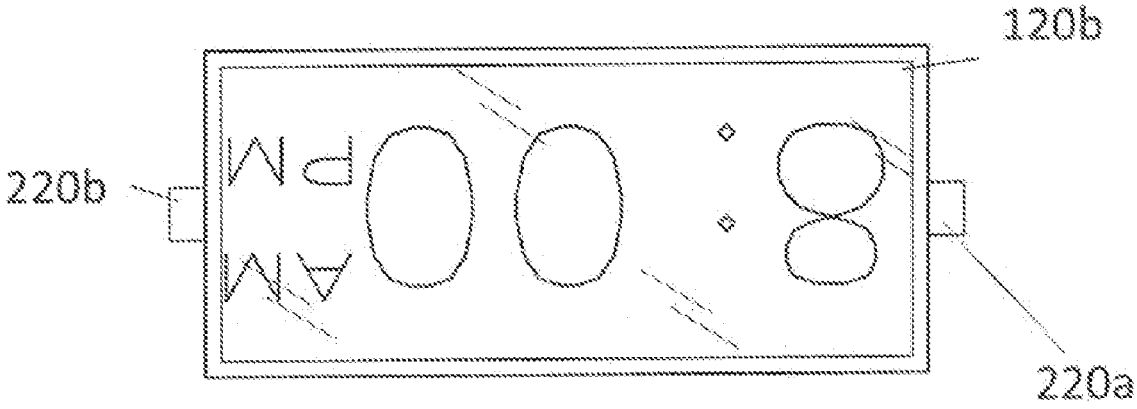
FIG. 3 is a front view of the second digital display of the clock device of the present invention.
Figure 4:
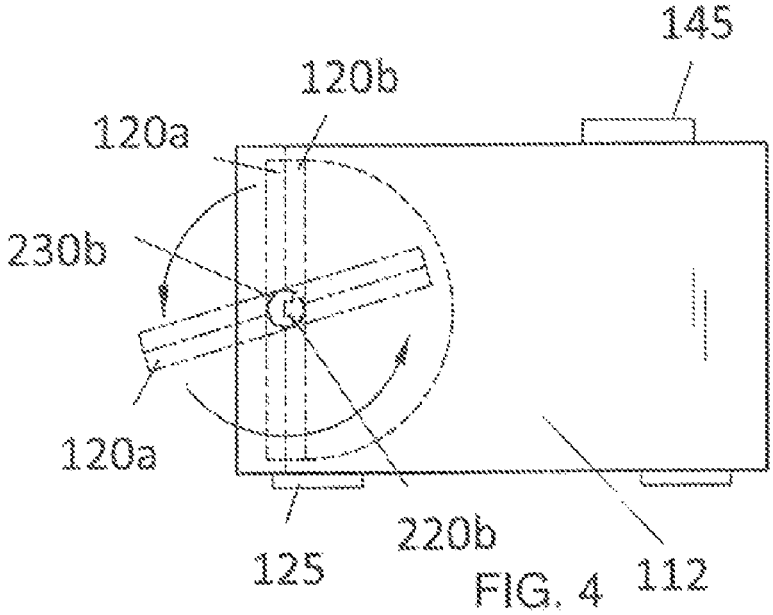
FIG. 4 is a side view of the clock device of the present invention.
Figure 5:
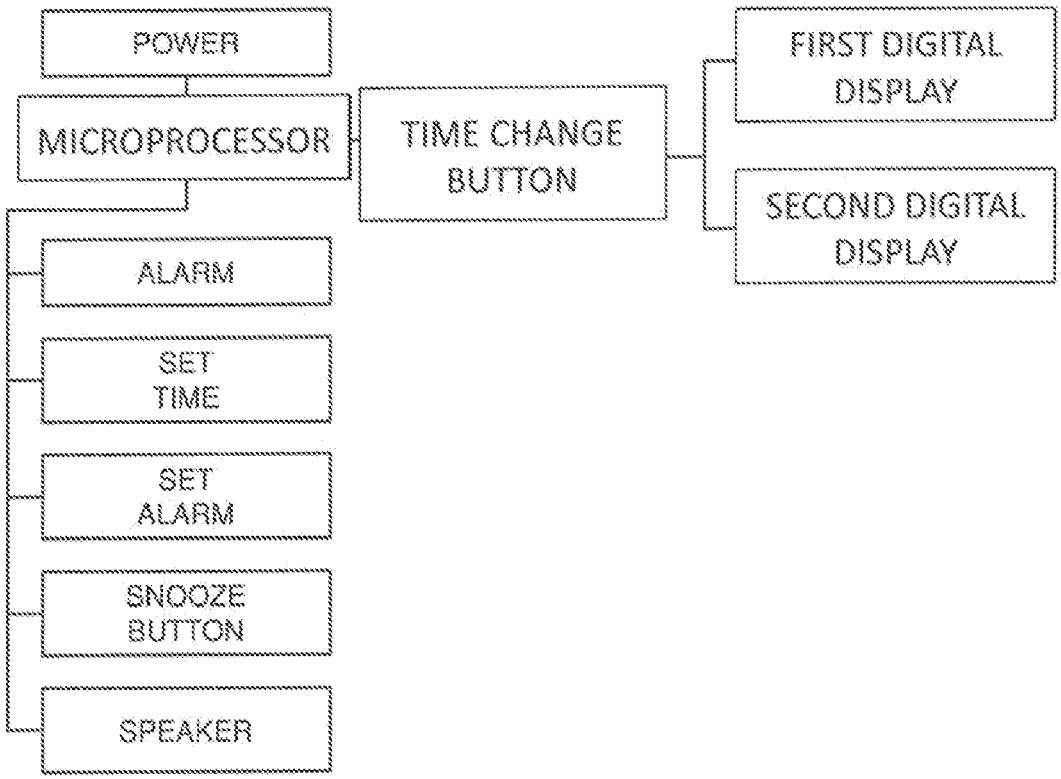
FIG. 5 is a schematic representation of the electrical components of the clock device of the present invention.

A first electrical contact 240*a* is disposed on the top front edge of the housing near the first side wall 111 and a second electrical contact 240*b* is disposed on the top front edge of the housing near the second side wall 112 (see FIG. 2). A third electrical contact 240*c* is disposed on the top edge of the display piece 120 near the second side edge and a fourth electrical contact 240*d* is disposed on the bottom edge of the display piece 120 near the first side edge. The first electrical contact 240*a* and second electrical contact 240*b* are each operatively connected to the microprocessor (and power source). When the display piece 120 is snapped into the recess in the front of the housing 110 with the first digital display 120*a* facing forwardly, the second electrical contact 240*b* on the housing 110 operatively connects to the third electrical contact 240*c* on the display piece 120, allowing the first digital display 120*a* to display the time (e.g., standard time). When the display piece 120 is snapped into the recess in the front of the housing 110 with the second digital display 120*b* facing forwardly, the first electrical contact 240*a* on the housing 110 operatively connects to the fourth electrical contact 240*d* on the display piece 120, allowing the second digital display 120*b* to display the time (e.g., daylight saving time).

In some embodiments, a fifth electrical contact 240*e* is disposed in the first shaft 220*a* on either the first digital display 120*a* and/or the second digital display 120*b*. A time change button 150 is disposed on the first side wall of the housing 110 aligned with the first shaft hole that accepts the first shafts 220 of the digital displays 120. The time change button 150 can pivot between at least a first position (e.g., standard time position) and a second position (e.g., daylight saving time position). The time change button 150 is operatively connected to the first shafts 220 of the digital displays 120. For example, in some embodiments, a sixth electrical contact is disposed on the time change button 150 that engages the fifth electrical contact 240*e*. Movement of the time change button 150 between the first and second positions causes the rotation of the digital displays 120 via the fifth and sixth electrical contacts. Or, in some embodiments, the time change button 150 is operatively connected to the first shafts 220 of the digital displays 120 such that when the time change button 150 is rotated the first shafts 220 are rotated, thereby rotating the digital displays 120.

The disclosures of the following U.S. Patents are incorporated in their entirety by reference herein: U.S. Pat. No. 4,920,365; U.S. Pat. No. 4,763,311; U.S. Pat. No. 4,953,149; U.S. Pat. No. 7,394,726; U.S. Pat. No. 5,901,115; U.S. Pat. No. D561,611.

Various modifications of the invention, in addition to those described herein, will be apparent to those skilled in the art from the foregoing description. Such modifications are also intended to fall within the scope of the appended claims. Each reference cited in the present application is incorporated herein by reference in its entirety.

Although there has been shown and described the preferred embodiment of the present invention, it will be readily apparent to those skilled in the art that modifications may be made thereto which do not exceed the scope of the appended claims. Therefore, the scope of the invention is only to be limited by the following claims.

The reference numbers recited in the below claims are solely for ease of examination of this patent application, and are exemplary, and are not intended in any way to limit the scope of the claims to the particular features having the corresponding reference numbers in the drawings.

What is claimed is:

1. A clock device that can switch between standard time and daylight saving time, said clock device comprises:

(a) a clock housing 110 having a speaker 130, a power source 117, and control buttons 140, the speaker 130, power source 117, and control buttons 140 are each operatively connected to a microprocessor 118, the microprocessor 118 is configured to digitally keep time in a standard manner, wherein a recess is disposed in a front area of the housing, wherein a first shaft hole is disposed in a first side wall 111 of the clock housing and a second shaft hole 230*b* is disposed in a second side wall 112 of the clock housing;

(b) a digital display piece 120 having a front face with a first digital display 120*a* and a back face with a second digital display 120*b*, the first digital display 120*a* is oriented in a first direction and the second digital display 120*b* is oriented in a second direction, the second direction being upside down with respect to the first direction, the first digital display 120*a* is adapted to display standard time and the second digital display 120*b* is adapted to display daylight saving time, the digital display piece 120 is adapted to fit into the recess in the front area of the housing 110;

(c) a first shaft 220*a* disposed on a first side of the digital display piece 120 and a second shaft 220*b* disposed on a second side of the digital display piece 120, the first shaft

220*a* is adapted to be inserted into the first shaft hole of the housing 110 and the second shaft 220*b* is adapted to be inserted into the second shaft hole 230*b* of the housing 110, the first shaft 220*a* can rotate within the first shaft hole and the second shaft 220*b* can rotate within the second shaft hole 230*b* such that the first digital display 120*a* is facing outwardly from the front area of the housing 110 or the second digital display 120*b* is facing outwardly from the front area of the housing 110;

(d) a first electrical contact 240*a* disposed on a top front edge of the housing 110 near the first side wall 111 and a second electrical contact 240*b* disposed on the top front edge of the housing 110 near the second side wall 112, the first electrical contact 240*a* and second electrical contact 240*b* are each operatively connected to the microprocessor 118;

(e) a third electrical contact 240*c* disposed on a top edge of the digital display piece 120 near the second side and a fourth electrical contact 240*d* disposed on a bottom edge of the display piece 120 near the first side, when the display piece 120 is engaged in the front area of the housing 110 with the first digital display 120*a* facing forwardly the second electrical contact 240*b* on the housing 110 operatively connects to the third electrical contact 240*c* on the display piece 120 and the microprocessor 118 sends a first output signal to the first digital display 120*a* to cause the first digital display 120*a* to display standard time, when the display piece 120 is engaged in the front area of the housing 110 with the second digital display 120*b* facing forwardly the first electrical contact 240*a* on the housing 110 operatively connects to the fourth electrical contact 240*d* on the display piece 120 and the microprocessor 118 sends a second output signal to the second digital display 120*b* to cause the second digital display 120*b* to display daylight saving time; and (f) a time change button 150 disposed on the first side wall 111 of the housing 110, the time change button 150 is aligned with the first shaft hole in the housing 110, the time change button 150 is operatively connected to the first shaft 220*a* of the digital display piece 120, the time change button 150 can pivot between at least a first position and a second position, when the time change button 150 is in the first position the first digital display 120*a* faces forwardly and when the time change button 150 is in the second position the second digital display 120*b* faces forwardly.

2. The clock device of claim 1, wherein the control buttons 140 include clock setting buttons, alarm setting buttons, volume buttons, and a snooze button 145.

3. The clock device of claim 1 further comprising a footing 125 disposed on a bottom surface of the housing for traction.

4. The clock device of claim 1, wherein the first digital display 120*a* and the second digital display 120*b* are separate pieces that together form the digital display piece 120.

5. The clock device of claim 1, wherein the power source 117 is a battery.

6. The clock device of claim 5, wherein the battery is a rechargeable battery.

7. The clock device of claim 1, wherein a fifth electrical contact 240*e* is disposed in the first shaft 220*a* of the digital display piece 120.

8. The clock device of claim 7, wherein the time change button 150 is operatively connected to the fifth electrical contact 240*e*.

* * * * *